United States Patent [19]

Hobb

[11] Patent Number: 4,936,630

[45] Date of Patent: Jun. 26, 1990

[54] CHAIR ADJUSTER

[75] Inventor: Gordon D. Hobb, Durham, England

[73] Assignee: Northeastern Components (International) Ltd., Tyne & Wear, Great Britain

[21] Appl. No.: 334,719

[22] Filed: Apr. 6, 1989

[30] Foreign Application Priority Data

Apr. 7, 1988 [GB] United Kingdom ..... 8808161

[51] Int. Cl.[5] ..... A47C 1/024

[52] U.S. Cl. ..... 297/363; 297/355; 297/361

[58] Field of Search ..... 297/355, 361, 363, 306, 297/313, 326–328

[56] References Cited

U.S. PATENT DOCUMENTS 1,681,643 8/1928 Kimbro ..... 297/363
3,336,079 8/1967 Radke et al. ..... 297/361 X
4,040,663 8/1977 Christensen ..... 297/361
4,065,176 12/1977 Fontana ..... 297/361 X

FOREIGN PATENT DOCUMENTS 1261312 1/1972 United Kingdom ..... 297/361
2044607 10/1980 United Kingdom ..... 297/361

*Primary Examiner*—Peter R. Brown
*Attorney, Agent, or Firm*—Rodman & Rodman

[57] ABSTRACT

An improved mechanism for adjusting the angle of inclination of the back-rest of a seat includes an elongated support arm for the back-rest, pivoted in the region of its lower end upon a transverse, generally horizontal pivot, a pair of complementary cams which are in relatively fixed relationship with each other and which abut the support arm on its opposite sides and on opposite sides of the pivot, and a screw mechanism for moving the cams in a direction transverse to the length of the support cam.

7 Claims, 1 Drawing Sheet

CHAIR ADJUSTER

The present invention relates to an adjuster for varying the angle of the back-rest of a chair of the type often referred to as a "typist's" chair.

Chairs of the aforesaid type, which are designed to support a person in an upright sitting position for long periods, usually incorporate at least two adjustment facilities, namely one for adjusting the height of the seat and a second one for varying the angle of inclination of the back-rest relative to the seat. If the back-rest is to function properly, it is likely to be under pressure from the back of the user most of the time that the chair is occupied. This constant pressure may impose a strain on the adjustment mechanism. When the back-rest is continuously adjustable by means of spring-loaded or mechanically compressed clutch plates, which is the usual approach, difficulties may arise in use. For example, pressure on the back-rest may overcome the friction between the plates, thus causing the plates to slip and the back-rest to yield. Clearly this undermines the whole function of the back-rest and fails to support the user's back as required.

Against this background, the present invention has been devised to provide an improved mechanism for adjusting the angle of inclination of a chair back-rest, which mechanism may be simple in design and operation but of improved stability in use.

The improved mechanism according to the present invention for adjusting the angle of inclination of a back-rest comprises an elongated back-rest support arm, pivoted at a point spaced from one end thereof upon a generally horizontal pivot transverse to the length of said support arm, a pair of complementary cams, mounted in fixed relative relationship and with the respective cam faces in abutment with said support arm on opposite sides thereof and on opposite sides of said generally horizontal pivot, and screw means for moving said cam faces in a direction transverse to the length of said support arm.

It will be understood that the movement of the cam faces across the length of the support arm at its lower end causes the support arm to rock about the horizontal pivot while remaining in contact with the cam faces throughout its movement. In this way, the upper end of the support arm (and a back-rest thereon) is tipped towards or away from the user as desired, pressure of the user on the back-rest being firmly borne by the two cam faces in all its positions.

The elongated back-rest support arm may be solid but usually, and preferably, is hollow. It may be of any desired cross-section but is preferably of curved cross-section, at least in the region where it abuts the cam faces. Typically, the support arm is upwardly-extending about a major part of its length but is generally horizontal in the region of its lower end.

The support arm is pivoted about a horizontal pivot, transverse to its length, at a point spaced from one end thereof. It is necessary that the pivot point be spaced from the end of the support arm in this way to enable one of the cam faces to abut the support arm at a point between the pivot and the end of the support arm but the distance from the pivot to the end of the arm may be relatively small, for example less than 10 cm., preferably of the order of 5 or 6 cm. Conveniently, the support arm is pivoted upon a pivot pin or spindle extending transversely across the upper face of the lower end of the support arm.

The support arm is caused to pivot by a pair of complementary cams abutting its lower end. The cams face each other, albeit in positions separated by the pivot, on opposite sides of the support arm. The cam faces are complementary in shape, in the sense that, as the support arm moves down one cam face, it remains in contact with the second cam face as it moves up that second face. Subject to that condition, the two cam faces may be curved, but it is preferred that the two cam faces be linear faces, inclined to the horizontal each by the same angle. That angle may conveniently be in the region of about 20 to 40 degrees, preferably approximately 30 degrees.

The cams are secured together or formed integrally with each other and are mounted for movement transverse to the length of the support arm. Thus they may be mounted upon a carriage, in turn mounted for transverse movement as aforesaid. That movement may be continuously controllable or may, less preferably, be a step-wise movement between stops. It is particularly preferred to provide for continuously-adjustable movement of the cams by means of a screw-threaded mechanism, preferably operated by a handwheel.

The invention will now be further described with reference to the accompanying drawings, which illustrate, by way of example only, one preferred embodiment of chair adjustment mechanism according to the invention. In the drawings.

Figure 1:
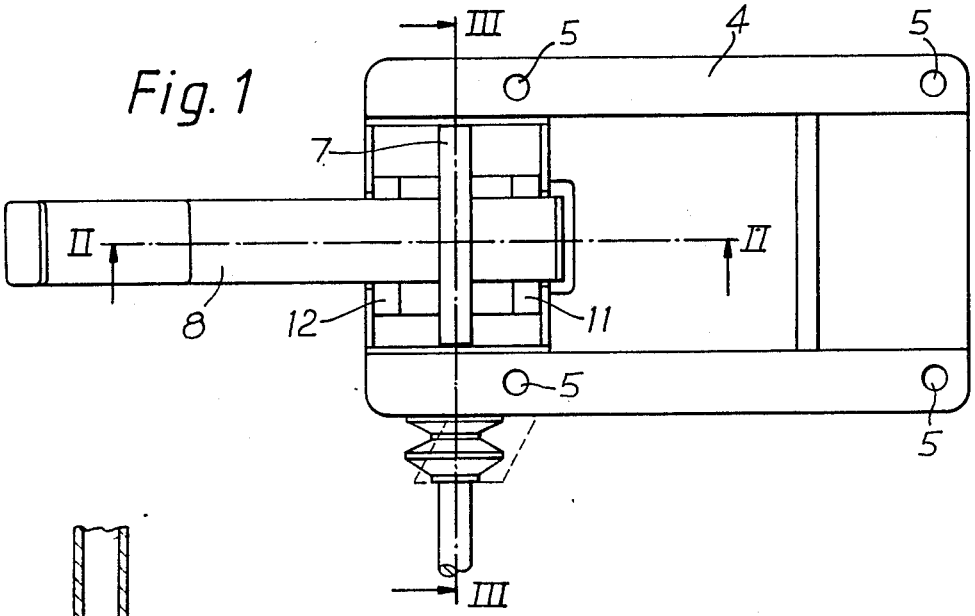
FIG. 1 is a plan view of the mechanism.

The illustrated mechanism is built upon a housing 4, secured to the underside of the seat of a chair by means of screws or bolts passing through holes 5. A pivot pin 6, mounted with its ends in the housing 4, is concentrically surrounded by a tube 7, to which a tubular back support arm 8 is welded at 9. Thus the arm 8 is pivoted to swing about the pin 6 and thereby to permit a back-rest (not shown), carried at the upper end of the arm 8, to swing towards and away from the back of a person sitting on the seat. The support arm 8 is of a somewhat flattened, rounded cross-section, as best seen in FIG. 3.

Within the housing 4 is located a carriage 10, supporting opposed cams 11, 12, which abut the lower end of the support arm 8 on its opposite sides and on opposite sides of the pivot pin 6. As indicated in outline in FIG. 3, the cam 12 is of equal and opposite inclination (approximately 30 degrees to the horizontal) to the cam 11. The cams are moved across the length of the support arm 8 by means of an actuator screw 13 made of glass-reinforced nylon, operating against a fixed nut 14 and rotated by a handwheel 15.

Figure 2:
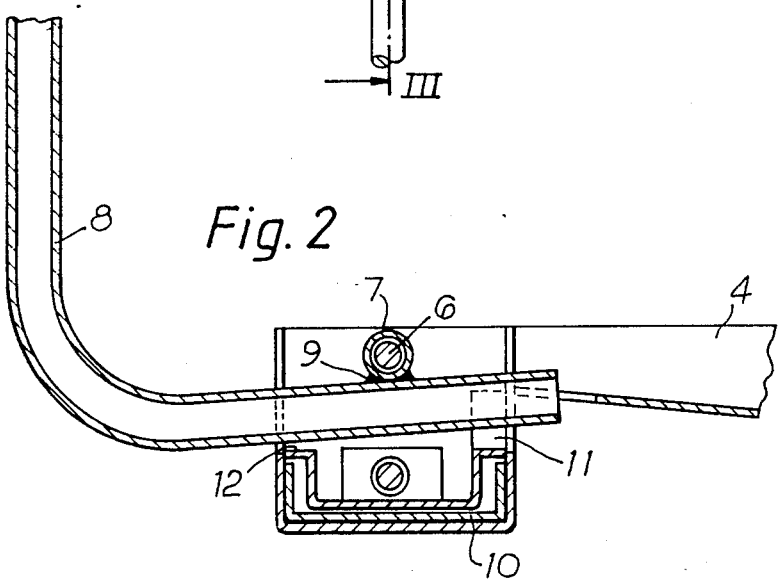
FIG. 2 is a vertical sectional view on the line II—II of FIG. 1.
Figure 3:
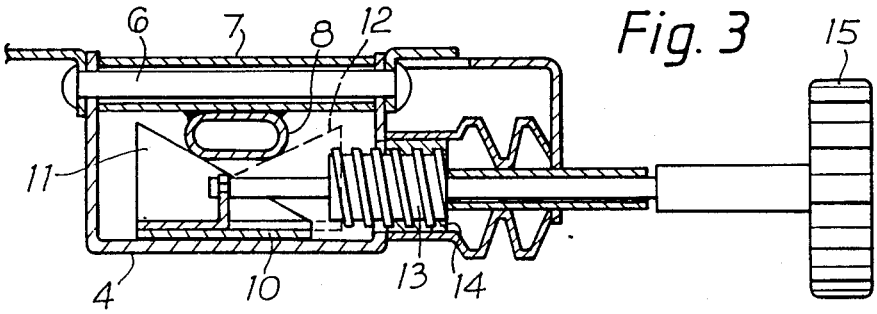
FIG. 3 is a vertical sectional view on the line III—III of FIG. 1.

In use of the chair, rotation of the handwheel 15 in a clockwise direction moves the cams to the left as illustrated in FIG. 3. The support arm 8 thus rides up the cam 12 and down the cam 11, while remaining throughout in contact with both cams. As the arm 8 rides up the cam 12, it is caused to pivot about the pin 6, in a clockwise direction relative to FIG. 2, and thus moves the back-rest towards the back of the user. Reverse operation of the handwheel 15 causes the cam 11 to pivot the arm 8 in the opposite direction.

The chair adjustment mechanism according to the present invention has several beneficial characteristics, both in general and also more specifically in the form of the illustrated Thus solid support for the back-rest against pressure from the user is afforded throughout its use by the fact that the support arm is abutted by a cam on each side. Moreover operation of the adjustment mechanism by a screw working through cams as described reduces substantially any tendency for pressure on the tack-rest to rotate the screw in reverse. The slipping which can occur when adjustment is achieved by means of clutch plates is eliminated. Finally, since, in the illustrated embodiment, the limits of adjustment are determined by the limits of linear movement of the cams within the housing, the back-rest cannot move backwardly into a potentially dangerous position even if the threads of the actuator screw were to collapse suddenly in use.

I claim:

1. An improved mechanism for adjusting the angle of inclination of the back-rest of a seat, comprising an elongated support arm for a back-rest, which support arm is pivoted at a point spaced from one end thereof upon a pivot transverse to the length of said support arm, two complementary cams, mounted in fixed relative relationship to each other with respective cam faces in abutment with said support arm on opposite sides of said support arm, said cam faces being also on opposite sides of said pivot, and screw means for moving said cams in a direction transverse to the length of said support arm.

2. An adjustment mechanism according to claim 1, wherein said support arm is of curved cross-section in the region where it abuts said cam faces.

3. An adjustment mechanism according to claim 1, wherein said support arm is non-linear, whereby one part of its length is inclined at an angle to a second part of its length.

4. An improved mechanism for adjusting the angle of inclination of the back-rest of a seat, comprising an elongated support arm having a first length adjacent a first end thereof inclined at an angle to a second length adjacent a second end thereof and being pivoted at a point spaced from said first end thereof upon a pivot extending transversely with respect to said first length of said support arm, two cams having respective complementary faces in abutment with opposite sides of said first length of said support arm, said cams being mounted in fixed relationship to each other with one of said cam faces abutting the support arm at a point between said pivot point and said first end and with the other of said cam faces abutting the support arm at a point on said first length which is on that side of said pivot point which is remote from said first end, and a screw-threaded mechanism for moving said cams in a direction transverse to said first length of said support arm.

5. An improved adjustment mechanism according to claim 4, wherein said cams are mounted upon a carriage and said carriage is mounted for movement transverse to said first length of said support arm.

6. An improved adjustment mechanism according to claim 5, wherein the two cams have linear cam faces, inclined in opposite directions at equal angles to a line transverse to said first length of said support arm.

7. An improved adjustment mechanism according to claim 6, wherein said equal angles lie within the range from about 20 to about 40 degrees.

* * * * *